US006893308B1

(12) United States Patent
Hayles

(10) Patent No.: US 6,893,308 B1
(45) Date of Patent: May 17, 2005

(54) RESCUE LOFT

(76) Inventor: David H. Hayles, 25907 W. Verandah Ct., Stevenson Ranch, CA (US) 91381

( * ) Notice: Subject to any disclaimer, the term of this patent is extended or adjusted under 35 U.S.C. 154(b) by 0 days.

(21) Appl. No.: 10/778,763

(22) Filed: Feb. 13, 2004

(51) Int. Cl.[7] ..... B63C 9/00
(52) U.S. Cl. ..... 441/83
(58) Field of Search ..... 441/83; 244/137.2, 244/138 R

(56) References Cited

U.S. PATENT DOCUMENTS

| | | | | |
|---|---|---|---|---|
| 3,421,165 | A * | 1/1969 | Pugh | 441/83 |
| 4,066,144 | A | 1/1978 | Valerio, Jr. | |
| 4,138,077 | A | 2/1979 | Okumura | |
| 4,188,000 | A | 2/1980 | Dalziel | |
| 4,204,710 | A | 5/1980 | Rothaemel et al. | |
| 4,398,760 | A | 8/1983 | Kirk | |
| 4,627,821 | A * | 12/1986 | Bradley et al. | 441/83 |
| 4,642,061 | A | 2/1987 | Arney | |
| 4,652,246 | A | 3/1987 | Thorgeirsson et al. | |
| 4,678,446 | A | 7/1987 | Dahan | |
| 4,753,620 | A | 6/1988 | Arney | |
| 4,861,299 | A | 8/1989 | Ueberschaer | |
| 5,086,998 | A | 2/1992 | Pelas | |
| 5,158,489 | A | 10/1992 | Araki et al. | |
| 5,320,566 | A | 6/1994 | Low, Jr. | |
| 5,370,565 | A | 12/1994 | Yanez | |
| 5,484,313 | A | 1/1996 | Rachal et al. | |
| 5,832,547 | A | 11/1998 | Burroughs | |
| 6,475,047 | B2 | 11/2002 | Cynamon | |
| 6,520,817 | B1 | 2/2003 | Salzman | |
| 6,533,626 | B2 | 3/2003 | Pons | |
| 6,575,799 | B1 | 6/2003 | Stimpson et al. | |
| 6,604,747 | B2 | 8/2003 | Moore | |

* cited by examiner

*Primary Examiner*—Ed Swinehart
(74) *Attorney, Agent, or Firm*—Christie, Parker & Hale, LLP

(57) ABSTRACT

A rescue device to be deployed from an airborne device or aerial location, that has an upper portion, with a substantially rigid frame portion, lateral and transverse net members, that are coupled to the frame portion, and a substantially planar sheet member, that is coupled to the frame portion, an intermediate portion, with side portions having vertical net members, that extend downward from the perimeter of the upper portion, and are coupled to the lateral and transverse net members of the upper portion, and also having horizontal net members, that are coupled to the vertical net members, and a bottom portion, with lateral and transverse net members that are coupled to the vertical net members of the intermediate portion. The rescue device may also have a flotation device, coupled to the rescue device, and has multiple lines coupling the rescue device to a rigging plate, and multiple lines coupling the rigging plate to the airborne device.

20 Claims, 2 Drawing Sheets

RESCUE LOFT

BACKGROUND OF THE INVENTION

The present invention relates to emergency rescue devices, and more specifically, to a rescue device adapted for use from airborne or aerial devices.

A variety of emergency situations exist which cause the need for aerial rescues. Severe weather, rains, and general storm conditions often cause floods, leaving victims of the circumstances stranded in water. Such floods typically come somewhat unexpectedly, often trapping persons in their vehicles. Such vehicles generally become immobilized, forcing the occupants to flee to the highest point to escape the floodwaters, typically the roof of the vehicle. Thus emergency rescues are often attempted to retrieve one or more victims from the roof of a partially submerged vehicle. Similar situations precipitate the need for rescues from the roof of buildings, also surrounded by water. In addition to floods, other circumstances such as fires, earthquakes, landslides or other natural disasters often result in victims being stranded in a remote or isolated location, where a rescue by air is the only feasible means of rescue. For example, a fire in a high rise building often leads to a number of victims fleeing to the roof of the building, where an aerial rescue, such as by a helicopter or crane, could then be attempted.

In the past, rescues by helicopter were typically performed by lowering down a single line with a harness or basket on the end. A rescuer would typically accompany the rescue device down, and after disengaging himself or herself from the rescue device, would secure or engage a single victim to the device. The rescuer, along with any additional victims, were then forced to wait in the dangerous conditions while the rescue device holding the single victim was raised up into the helicopter, the victim was detached or disengaged from the rescue device, and the rescue device was lowered back down. The rescuer could then attempt to engage another victim with the rescue device, which would restart the raising and lowering procedure. However, such emergency circumstances often create a large number of victims, making it impractical to attempt to rescue victims one at a time. In such situations, where rapid rescue is critical to survival, multiple victims must be rescued together.

In addition to the slowness of such a rescue attempting to extricate one victim at a time, such single victim rescue devices are typically deployed with a single line, making the device especially susceptible to spinning. Such spinning can be dangerous, may cause victims to disengage from the rescue device, may affect the operation of the rescue device, and may also create fear and anxiety in the victim.

Thus there exists the need for a rescue device that may be deployed from an airborne or aerial location, such as a helicopter or crane, that allows for the rapid rescue of multiple victims, and that provides a safe area for the victims.

SUMMARY OF THE INVENTION

The present invention is embodied in a rescue device adapted for deployment from an airborne device or aerial location, which may be deployed rapidly, is easily transportable, which provides a large number of engagement areas for victims to take hold of, which is large enough to rescue multiple victims at a time, and which provide a safe area for victims.

One aspect of a particular embodiment of the present invention is that it is collapsible, allowing for easy transportation, and reduced drag when airborne, and also for easier storage when not in use.

Another aspect of a particular embodiment of the present invention is that it is universally adaptable to a variety of devices, and may be used from virtually any helicopter or crane, through a simple connection.

Another aspect of a particular embodiment of the present invention is that it is rapidly deployable, with a simple connection to the helicopter or crane, and a easy controls which allow a single rescuer to fully expand and deploy the device from its collapsed state upon arrival at a rescue location.

Another aspect of a particular embodiment of the present invention is that it provides a net type surface about its perimeter, presenting a large rescue area for victims to engage with, and once engaged, victims may enter into the safe area on the interior of the device.

Another aspect of a particular embodiment of the present invention is that it includes additional rescue areas through auxiliary rope, ladders, nets and other rescue devices extending from the bottom of the device.

Another aspect of a particular embodiment of the present invention is that it provides mesh floor and ceiling portions, as well as partial mesh side portions, to provide a degree protection from the elements, from the airflow created by the helicopter blades, and to partially obscure the view of victims inside the device to enhance the feeling of safety when airborne.

Another aspect of a particular embodiment of the present invention is that it includes flotation devices at the lower corners of the device, so that the device floats on the surface of water.

Another aspect of a particular embodiment of the present invention is that the bottom surface of the device includes an entrance, so that it may be entered from the bottom when the device is floating on or partially submerged in water.

Another aspect of a particular embodiment of the present invention is that it has a rigid upper structure, which retains the shape of the device, and adds strength to the device.

Another aspect of a particular embodiment of the present invention is that in has multiple connection lines securing it to a rigging plate, and multiple connection lines securing the rigging plate to a helicopter or crane. The multiple lines provide additional strength and safety, and are spaced sufficiently to reduce rotation of the device when in use.

Another aspect of a particular embodiment of the present invention is that it provides a safe area for victims, without the need for raising the device and transferring the victim to the helicopter, thereby eliminating the need and time delay of raising and lowering a safety device multiple times, and allowing for rapid and efficient rescue of multiple victims from a variety of situations.

Another aspect of a particular embodiment of the present invention is that the semi-enclosed area provided for the victims provides additional safety, protection from the elements, and is more calming to victims than a typical open, single cable rescue device.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

The details and features of the present invention may be more fully understood by referencing the detailed description and drawings, in which.

DETAILED DESCRIPTION OF THE INVENTION

Figure 1:
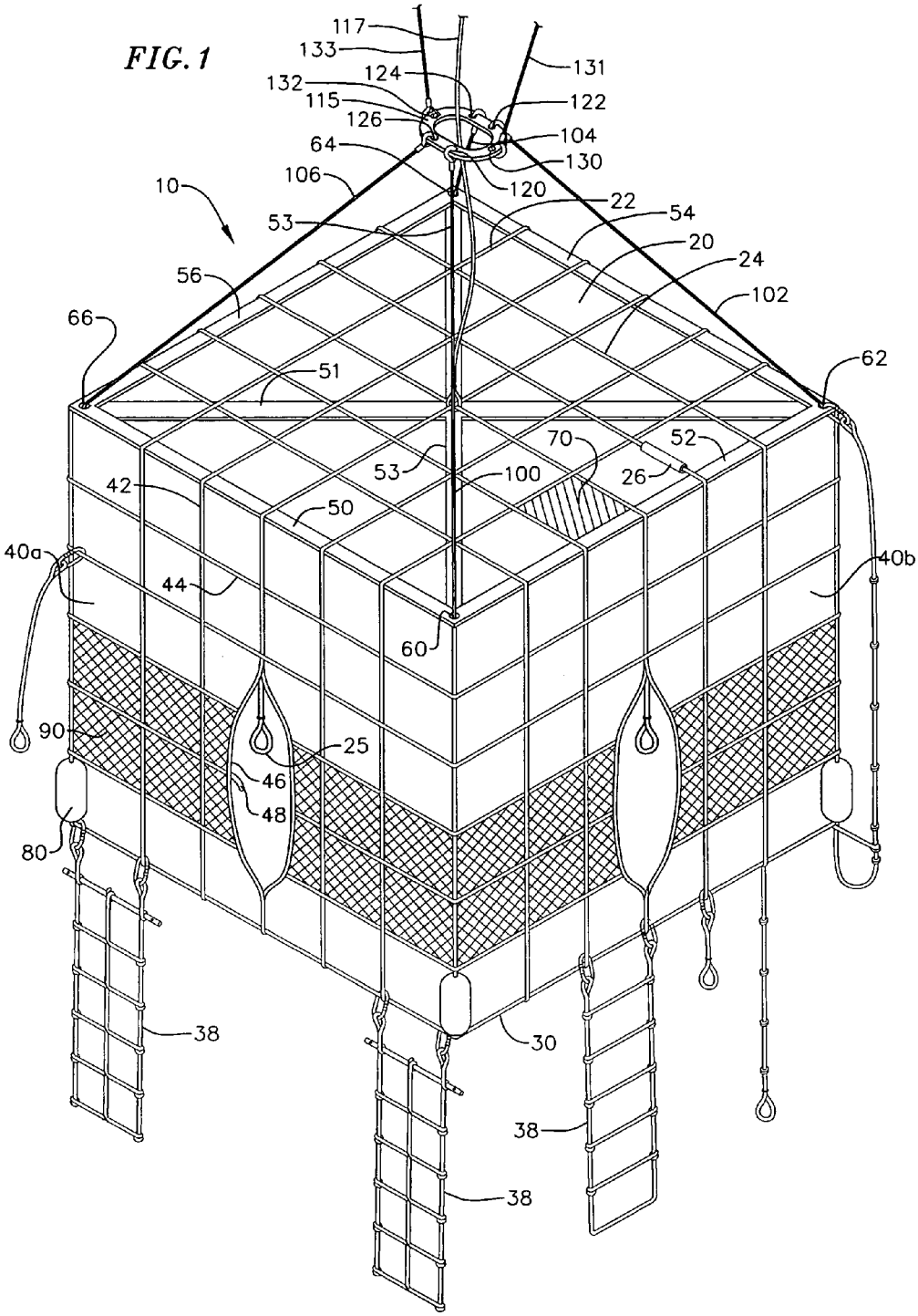
FIG. 1 is a perspective view of one embodiment of the present invention.

FIG. 1 illustrates a particular embodiment of the rescue device adapted for use from an airborne device or aerial location. As used in this application, "airborne device" includes, but is not limited to, helicopters, fixed wing aircraft, cranes, booms, towers, gondolas, or any other device or fixture from which the rescue device of the present invention could be deployed in a substantially airborne manner. In the embodiment shown, the device 10 is generally cubical in shape. In this embodiment, the device has a generally planar upper portion 20, a generally lower planar portion 30, and four generally planar side portions 40*a*, 40*b*, 40*c* and 40*d* (40*c* and 40*d* are not visible in this figure, but are similar in construction to 40*a* and 40*b*). In this embodiment, the device provides a cubical safety "loft" where victims may go for safety.

The upper portion 20 is comprised of a plurality of lateral net members 22, and transverse net members 24, such that each lateral net member 22 is substantially orthogonal to, and coupled to, a plurality of transverse net members, and each transverse net member 24 is substantially orthogonal to, and coupled to, a plurality of lateral net members 22. The lateral and transverse net members thereby define a grid or net. It will be appreciated by those skilled in the art that in another embodiment, the net members are not orthogonal to one another, yet still define a grid. In one embodiment, the net members comprise polypropylene rope. In another embodiment, at least a portion of the net members comprise a steel line, covered by plastic. In another embodiment, the net members are flat straps. In yet other embodiments, the net members comprise lightweight durable materials known to those skilled in the art. In another embodiment, the net members are brightly colored to enhance visibility. In another embodiment, a protective sleeve or covering 26 is placed over at least a portion of at least one of the net members, to enhance strength and durability, and to provide additional rigidity. In one embodiment, a plurality of such sleeves are placed over the lateral and transverse net members of the bottom portion of the device. In another embodiment, a plurality of such sleeves are placed over the vertical and horizontal net members of the intermediate portion of the device. In another embodiment, these sleeves or coverings 26 are brightly colored to enhance visibility. In another embodiment, these sleeves are clear, to allow easy inspection of the underlying net members.

The upper portion 20 also includes rigid frame members 50, 52, 54, 56 about the perimeter of the upper portion 20. In addition, rigid cross support frame members 51, 53 run diagonally from the corners of the upper portion. The frame members are flat plates, preferably of a high strength, low weight material such as aircraft grade aluminum. It will be appreciated, however, that in other embodiments, these rigid frame members are tubular, rather than flat. It will be further appreciated that in another embodiment, the rigid frame members are steel, and that in other embodiments, the frame members are fiberglass, carbon fiber, titanium, metallic alloys, or any other material known to those skilled in the art that is substantially rigid and possesses a high strength to weight ratio. In another embodiment, where less strength is required, or where a device of less weight is required, the upper portion 20 includes frame members 50, 52, 54, and 56, but omits the diagonal cross support frame members 51, 53. In yet another embodiment having reduced weight, the upper portion 20 includes cross support frame members 51, 53, but omits frame members 50, 52, 54, 56. It will be appreciated by those skilled in the art that in other embodiments, the arrangement of the frame members may be varied to provide a specific strength and/or weight, depending on the particular application. For example, in another embodiment, the upper portion 20 includes frame members 50, 54, and cross support frame members 51, 53, but omits frame members 52, 56. In one embodiment, the frame members are separate members. In another embodiment, the frame members are portions of a single member.

The upper portion 20, and more particularly, the frame members 50, 52, 54, 56, further defines ports 60, 62, 64, 66, which are adapted to allow lines of rope or cable to pass through without damaging either the rope or cable, or the upper portion 20 or support members 50, 52, 54, 56.

In one embodiment, the upper portion also includes a substantially planar flexible cover member 70. The cover portion provides some protection from the elements, as well from falling foreign objects, and also reduces the wind and noise which may be generated by helicopter blades, as well as reducing the visibility of such helicopter blades, which may be frightening to already unsettled victims, who are not accustomed to such airborne travel. In one embodiment, the cover member is a substantially opaque tarp. In another embodiment, the cover member is comprised of a mesh material. In another embodiment, the cover member is transparent. In another embodiment, the cover member covers less than the entirety of the upper portion. In yet another embodiment, the cover member extends beyond the perimeter of the upper portion, and covers at least a part of the intermediate portion of the device.

Each side of the device has a similar side portion 40*a*, 40*b*, 40*c*, 40*d*. Because the sides of the device are similar, the features will be described with respect to a single side. Side portion 40*a* includes a plurality of vertical net members 42 and horizontal net members 44. The vertical net members 42 extend from the lateral net members 22 of the upper portion. The horizontal net members are substantially orthogonal to, and coupled to, the vertical net members. The vertical net members extend around the perimeter of the device. In another embodiment, the vertical net members do not extend fully around the perimeter of the device, but are coupled to lateral or transverse net members around the perimeter of the device. Likewise, in the embodiment shown, the horizontal net members extend around the perimeter of the device. In another embodiment, the horizontal net members do not extend along the perimeter of the device, but are coupled to horizontal net members around the perimeter of the device. It will be appreciated by those skilled in the art that in other embodiments, the device has a different shape, depending on the specific application for which it is designed. In one embodiment, the device is in the shape of a tetrahedron, or pyramid, and has triangular side portions. In another embodiment, the device is cylindrical in shape. In yet another embodiment, the device is in the shape of a cylinder, having an octagonal cross section. The side portions are rectangular, while the upper and lower portions are octagonal.

The side portion 40*a* also includes an entrance 46 to the device, defined by parallel vertical net members which may be spread open to form a tear-drop shaped opening. The parallel net members may also be held together by closure 48, to keep the entrance closed. In one embodiment, closure 48 is a strap which is tied around the parallel vertical net members to keep them together. In another embodiment, closure 48 is a carabiner which is used to secure the parallel vertical net members together. In yet another embodiment, closure 48 is a split strap having mating portions of a hook and loop fastener, which can be deployed to secure the parallel vertical net members together.

In the embodiment shown, flotation devices 80 are located at the lowermost four corners of the device, secured to vertical net members. It will be appreciated that in another embodiment, the flotation devices are secured to horizontal net members. In yet another embodiment, flotation devices are secured to areas other than the lower corners of the device. Varying the location and/or buoyancy of the flotation devices allows for the device to float at a specific level. For some applications, it is desired that the device float on top of the water. In another application, the device floats partially submerged, to allow for easier entry into the device for victims.

In the embodiment shown each of the side portions also include a mesh panel 90 which partially covers the side portion. In the embodiment shown, the mesh panel extends downward from the midpoint of the side portion, but does not extend to the bottom of the side portion.

Figure 2:
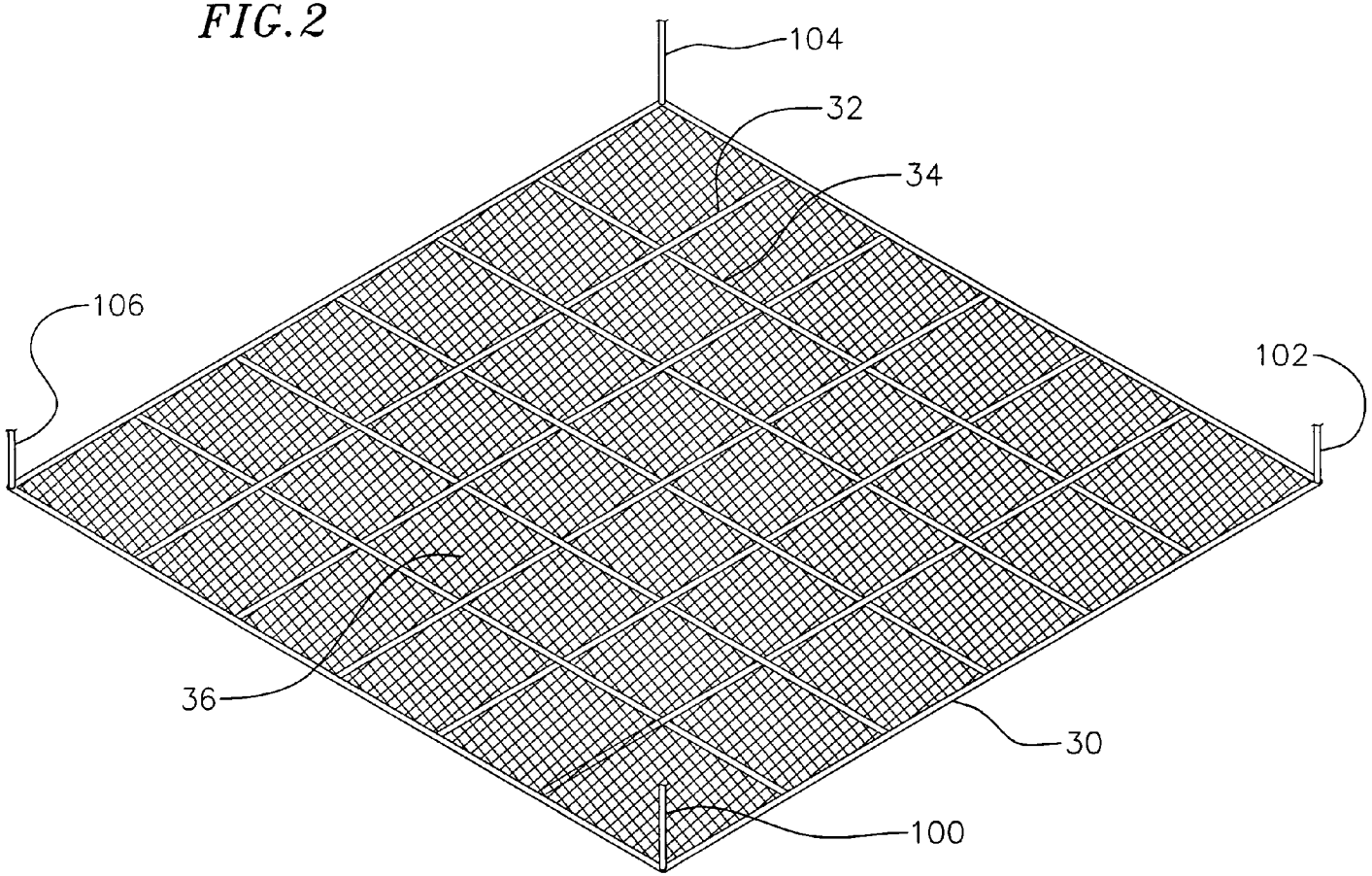
FIG. 2 is a perspective view of the bottom portion of one embodiment of the present invention.

The vertical net members of the respective side portions extend along the bottom of the device, forming the lateral 32 and transverse 34 members of the bottom portion 30 of the device, as shown in FIG. 2. In another embodiment, the vertical net members do not extend to the bottom of the device, but instead are coupled to the lateral and transverse members of the bottom portion 30 of the device.

As shown in FIG. 2, the bottom portion 30 also includes a floor panel 36. The floor panel provides a floor surface to the device. In one embodiment, the floor panel is located below the net members of the bottom portion. In another embodiment, the floor panel is located above the net members of the bottom portion, leaving the net members exposed to victims outside the device, so that they may take hold of them. In another embodiment, the floor panel 36 covers the entire bottom portion 30 of the device, but the floor panel 36 is above the lateral and transverse net members so that the net members are below the floor panel, and therefore exposed to victims reaching for the device from below the bottom portion of the device. In one embodiment, the floor panel is mesh. In another embodiment, the floor panel is opaque. In yet another embodiment, the floor panel is translucent. In yet another embodiment, the bottom portion 36 includes a buoyant floor portion.

Coupled to, and extending from the corners of the bottom portion 30 are lines 100, 102, 104, 106, which extend upward, through the respective pass through ports 60, 62, 64, 66 of the upper portion. In another embodiment, the lines 100, 102, 104, 106 are coupled to the respective ports 60, 62, 64, 66 and do not extend to the bottom portion of the device.

In the embodiment shown, the device also includes auxiliary rescue means for engagement 38, extending from the bottom portion 30 to provide additional rescue areas of engagement for victims. In the preferred embodiment, the auxiliary rescue means for engagement is a Swift Water Advanced Rescue Device, as described in the patent application entitled "Swift Water Advanced Rescue Device" by inventor David Hayles, filed Feb. 13, 2004. In another embodiment, the auxiliary rescue means for engagement is a ladder. In another embodiment, the auxiliary rescue means for engagement is a rope. In another embodiment, the auxiliary rescue means for engagement is a lanyard. In yet another embodiment, the auxiliary rescue means for engagement is a drop rope 39 attached to both the upper portion and bottom portion of the device, such that the rope extends beneath the plane of the bottom portion of the device, providing an additional loop for victims to engage. In a preferred embodiment, the auxiliary rescue means for engagement are attached by carabiner. In another embodiment, auxiliary rescue means for engagement are attached in locations on at least one of the side portions of the device.

In one embodiment, the rescue device of the present invention forms a cube-shaped rescue area, or loft, which provides a secure, safe area large enough to contain multiple victims. The loft allows victims to enter into a semi-enclosed area, rather than dangling in the open from a rope or cable, and further allows a rescuer to assist multiple victims into the loft while remaining relatively safe, and likely still tethered to a safety line, without the need to raise and lower the device multiple times in order to rescue multiple victims. This provides for a more timely and efficient rescue effort, not only providing a greater sense of safety and security to victims, but also providing increased actual safety as well, for both victims and rescuers. Further, the ability to rescue multiple victims at one time will typically alleviate the need to extract a single victim by raising and lowering a device, while making other victims wait for the device to return. The loft allows a greater number of victims to be placed in a safe environment in a shorter amount of time, and generally alleviates victims feeling left behind while they wait for rescuers to return due to one-at-a-time rescue efforts.

As illustrated in the embodiment shown in FIG. 1, the lines 100, 102, 104, 106 extend upward from the bottom portion of the device, up through the respective ports 60, 62, 64, 66, and up to the rigging plate 115. The rigging plate includes ports 120, 122, 124, 126 to receive the respective lines 100, 102, 104, 106. The plate has a smooth finish, to minimize the chance that the lines could snag on any portion of the plate, and to prevent any undue wear or stress that rough edges would cause on the lines. The plate also includes ports 130, 132 to which are coupled the lines 131, 133 going to the airborne lifting device, such as a crane or helicopter, or to some other aerial location. In one embodiment, the rigging plate is oval, to avoid sharp surfaces which may damage lines. In another embodiment, the rigging plate is rectangular, with rounded corners. It will be appreciated that in other embodiments, the shape of the rigging plate is varied, depending upon the particular application. In another embodiment, where greater lifting strength is required, the rigging plate has additional ports, and additional lines are run to the airborne lifting device. The use of two or more lines attaching to the airborne lifting device assists in reducing spinning of the device, which is common to single line rescue devices. In one embodiment, where additional safety is required, each line attaching to the airborne lifting device is rated to lift the entire weight, thereby providing complete redundancy, and the safety of a backup line in the event of a failure of one of the lines.

The rigging plate 115 defines a central cavity 117, adapted to allow control line 117 to pass through. Control line 117 is coupled to the upper portion of the device at one end, and the other end of the control line is coupled to the helicopter, preferably to a winch or other lifting device.

When first attached to a helicopter or crane, the device 10 is typically in its collapsed position. Although this device may be used in a wide variety of situations and applications, it will often be used to rescue victims stranded in an isolated location, such as on a structure or vehicle caught in flood waters, or a sinking vessel at sea, or victims caught on top of a structure, such as a burning skyscraper, requiring the device to be transported to the rescue location. While a helicopter is the typical airborne lifting device, a crane may also be used, such as by one ship rescuing another, or even in land based operations, where a crane may be used to rescue persons stranded on a particular structure. Regardless of the type of airborne lifting device, the rescue device will be transported to the rescue location. Upon arrival at the rescue location, the device is fully deployed by raising control line 117, thereby raising the upper portion of the device. Control line 117 is raised until the upper portion 20 reaches a predetermined position. The control line is then secured, securing the upper portion in the raised position.

In an embodiment previously described, where the lines 100, 102, 104, 106 are coupled to the respective ports 60, 62, 64, 66 of the upper portion 20 and not to the bottom portion of the device, the control line 117 is coupled to the bottom portion 30 of the device. In this embodiment, the device 10 is again transported in its collapsed position. Upon arrival at the rescue location, the device is fully deployed by lowering the control line 117, thereby lowering the bottom portion 30 of the device. In another embodiment, rigid members are coupled to the perimeter of the bottom portion 30 of the device, to add rigidity to the structure, and aid in deployment by lowering by adding a very small amount of weight to the bottom portion. In yet another embodiment, the bottom portion 30 contains a substantially rigid floor. In another embodiment, this floor is buoyant. In another embodiment, the rigid floor is partially buoyant.

In the embodiment shown in FIG. 1, lanyards 25 are attached to the inside of the device, providing additional handholds for victims. In a preferred embodiment, the lanyards are coupled to the device by carabiners. In another embodiment, lanyards are coupled to the outside of the device to provide additional handholds for victims.

In one embodiment, when the device is stowed in its collapsed position, or when being transported in its collapsed position, it is easily maintained in such position by a locking mechanism. In one embodiment, the locking mechanism is a carabiner coupling a net member of the upper portion to a net member of the bottom portion. In another embodiment, straps having a hook and loop fastener attached are coupled to a plurality of locations on the upper portion, which straps are wrapped around a net member of the bottom portion and fastened.

In one embodiment, the device has approximate dimensions of six feet by six feet by six feet, and the net members define a grid having sections approximately one foot square. It will be appreciated by those skilled in the art that the size of the device may be varied depending on the particular application without departing from the teaching of the present invention.

Although the invention has been described in detail with reference only to the preferred embodiments, those having ordinary skill in the art will appreciate that various modifications, including modifications to shape and size, can be made without departing from the spirit and scope of the invention. Accordingly, the invention is defined with reference to the following claims.

What is claimed is:

1. A rescue device adapted for deployment from an airborne device comprising:

an upper portion comprising a substantially rigid frame portion, a plurality of lateral and transverse net members coupled to the frame portion, and a substantially planar sheet member coupled to the frame portion;

an intermediate portion comprising a plurality of side portions extending downward from the perimeter of the upper portion, each comprising a plurality of vertical net members coupled to the net members of the upper portion and a plurality of horizontal net members coupled to the vertical net members;

a bottom portion comprising a plurality of lateral and transverse net members coupled to the vertical net members of the intermediate portion;

a flotation device coupled to the rescue device;

a plurality of first support lines coupling the rescue device to a rigging plate; and a plurality of second support lines adapted for coupling the rigging plate to the airborne device.

2. A rescue device as in claim 1, wherein the frame portion is comprised of plurality of frame members.

3. A rescue device as in claim 1, wherein the lateral net members and the transverse net members of the upper portion are substantially orthogonal to one another.

4. A rescue device as in claim 1, wherein the vertical net members and the horizontal net members of the intermediate portion are substantially orthogonal to one another.

5. A rescue device as in claim 1, wherein at least two of the vertical net members define an entrance.

6. A rescue device as in claim 1, the bottom portion further comprising a substantially planar sheet member.

7. A rescue device as in claim 6, wherein the sheet member is substantially rigid.

8. A rescue device as in claim 6, wherein the sheet member is substantially buoyant in water.

9. A rescue device as in claim 1, wherein the flotation device is coupled to the intermediate portion of the device.

10. A rescue device as in claim 1, further comprising a lanyard coupled to the rescue device.

11. A rescue device as in claim 1, further comprising at least one auxiliary rescue means for engagement coupled to the bottom portion of the rescue device.

12. A rescue device as in claim 1, further comprising at least one auxiliary rescue means for engagement coupled to the intermediate portion of the rescue device.

13. A rescue device as in claim 1, wherein the plurality of first support lines are coupled to the bottom portion of the rescue device.

14. A rescue device as in claim 1, wherein the plurality of first support lines pass through the upper portion of the rescue device, and are coupled to the bottom portion of the rescue device.

15. A rescue device as in claim 1, wherein the plurality of first support lines are coupled to the upper portion of the rescue device.

16. A rescue device as in claim 1, wherein the plurality of first support lines are coupled to the frame portion of the rescue device.

17. A rescue device as in claim 1, further comprising a control line coupled to the upper portion of the rescue device, and adapted to raise and lower the upper portion of the rescue device.

18. A rescue device as in claim 1, further comprising a control line coupled to the bottom portion of the rescue device, and adapted to raise and lower the bottom portion of the rescue device.

19. A method of rescue from an airborne device comprising:

coupling a collapsible rescue device, in its collapsed configuration, to a device adapted to become airborne;

transporting the rescue device, in its collapsed configuration, via the airborne device to a rescue location;

locating one or more victims to be rescued;

deploying the rescue device by configuring the rescue device into its non-collapsed configuration and maneuvering the airborne device to locate the rescue device near to one or more victims;

assisting victims in engaging with the rescue device;

assisting victims engaged with the rescue device into entering inside the rescue device;

securing the victims within the device; and transporting the victims to a location apart from the rescue location.

20. A rescue device adapted for deployment from an airborne device comprising:

an upper portion comprising a substantially rigid frame portion, a plurality of lateral and transverse net members coupled to the frame portion, and a substantially planar sheet member coupled to the frame portion;

a collapsible intermediate portion, comprising a plurality of side portions extending downward from the periphery of the upper portion, each side portion comprising a plurality of vertical net members coupled to the net members of the upper portion and a plurality of horizontal net members coupled to the vertical net members, wherein at least two of the vertical net members define an entranceway;

a bottom portion, comprising a plurality of lateral and transverse net members coupled to the vertical net members of the intermediate portion and a substantially planar sheet member coupled to a plurality of the lateral and transverse net members;

a rigging plate;

a plurality of first support lines coupling the rescue device to the rigging plate;

a plurality of second support lines adapted to couple the rigging plate to the airborne device;

a control line coupled to the rescue device adapted to expand and collapse the rescue device; and an auxiliary rescue means for engagement coupled to the rescue device.

* * * * *